US007989701B2

(12) United States Patent
Kosaka et al.

(10) Patent No.: US 7,989,701 B2
(45) Date of Patent: Aug. 2, 2011

(54) MULTICONDUCTOR CABLE ASSEMBLY AND FABRICATION METHOD THEREFOR

(75) Inventors: Kazunari Kosaka, Mibu-Machi (JP); Xiucuo Li, Shanghai (CN); Wei Shan, Shanghai (CN)

(73) Assignee: Sabic Innovative Plastics IP B.V. (NL)

( * ) Notice: Subject to any disclaimer, the term of this patent is extended or adjusted under 35 U.S.C. 154(b) by 185 days.

(21) Appl. No.: 12/255,691

(22) Filed: Oct. 22, 2008

(65) Prior Publication Data

US 2009/0133896 A1 May 28, 2009

Related U.S. Application Data

(60) Provisional application No. 60/990,325, filed on Nov. 27, 2007.

(51) Int. Cl.
*H01B 7/00* (2006.01)

(52) U.S. Cl. ..... 174/110 R; 174/120 R

(58) Field of Classification Search ..... 174/36, 174/110 R, 113 R, 120 R, 121 R, 120 SC
See application file for complete search history.

(56) References Cited

U.S. PATENT DOCUMENTS

| | | | |
|---|---|---|---|
| 2,749,261 | A | 6/1956 | Hardison |
| 3,226,278 | A | 12/1965 | Scofield et al. |
| 3,728,424 | A | 4/1973 | Bauer |
| 3,833,443 | A | 9/1974 | Naseth et al. |
| 3,964,959 | A | 6/1976 | Adams |
| 4,150,929 | A | 4/1979 | Brandt |
| 4,295,812 | A | 10/1981 | Hodinott |
| 4,381,208 | A | 4/1983 | Baverstock |
| 4,430,139 | A | 2/1984 | Baverstock |
| 4,478,778 | A | 10/1984 | Look |
| 4,783,579 | A | 11/1988 | Brandolf et al. |
| 5,258,455 | A | 11/1993 | Laughner et al. |
| 5,550,190 | A | 8/1996 | Hasegawa et al. |
| 5,917,154 | A | 6/1999 | Mortier |
| 6,273,977 | B1 | 8/2001 | Harden et al. |
| 6,627,701 | B2 | 9/2003 | Adedeji et al. |
| 6,737,586 | B2 | 5/2004 | Inagaki et al. |
| 6,872,777 | B2 | 3/2005 | Adedeji et al. |
| 6,954,983 | B2 | 10/2005 | Froschl et al. |
| 6,974,907 | B2 | 12/2005 | Nagai et al. |
| 7,084,347 | B2 | 8/2006 | Mhetar et al. |
| 7,136,556 | B2 | 11/2006 | Brown et al. |

(Continued)

FOREIGN PATENT DOCUMENTS

| | | | |
|---|---|---|---|
| EP | 97414 | A1 | 1/1984 |

(Continued)

OTHER PUBLICATIONS

ASTM D790-03, Standard Test Methods for Flexural Properties of Unreinforced and Reinforced Plastics and Electrical Insulating Materials, May 25, 2004, 11 pages.

(Continued)

*Primary Examiner* — William H Mayo, III
(74) *Attorney, Agent, or Firm* — Cantor Colburn LLP

(57) ABSTRACT

A multiconductor cable assembly includes two or more coated wires in a side-by-side contacting relation, and the covering of the wires includes a composition with specific proportions of a poly(arylene ether), a block copolymer, and a flame retardant. The multiconductor cable assembly can be formed by extrusion coating two or more uncoated conductors, or by passing two or more coated wires through a nip defined by two rollers to fuse the coated wires.

22 Claims, 3 Drawing Sheets

U.S. PATENT DOCUMENTS

| | | | |
|---|---|---|---|
| 7,186,031 | B2 | 3/2007 | Yang et al. |
| 7,207,732 | B2 | 4/2007 | Fabian et al. |
| 7,217,886 | B2 | 5/2007 | Mhetar et al. |
| 7,237,966 | B2 | 7/2007 | Quinby et al. |
| 7,247,347 | B2 | 7/2007 | Andrieu et al. |
| 7,408,116 | B2 | 8/2008 | Chiruvella et al. |
| 2005/0154100 | A1 | 7/2005 | Kosaka et al. |
| 2005/0226582 | A1 | 10/2005 | Nagelvoort et al. |
| 2005/0228063 | A1 | 10/2005 | Komiya et al. |
| 2006/0106139 | A1 | 5/2006 | Kosaka et al. |
| 2006/0131059 | A1 | 6/2006 | Xu et al. |
| 2006/0167143 | A1 | 7/2006 | Borade et al. |
| 2006/0182967 | A1 | 8/2006 | Kosaka et al. |
| 2007/0261878 | A1 | 11/2007 | Kosaka et al. |
| 2008/0006435 | A1 | 1/2008 | Scheel et al. |

FOREIGN PATENT DOCUMENTS

| | | | |
|---|---|---|---|
| EP | 938099 | A1 | 8/1999 |
| GB | 678042 | A | 8/1952 |
| GB | 1386065 | A | 3/1975 |
| GB | 1390152 | A | 4/1975 |
| WO | 9712377 | A1 | 4/1997 |
| WO | 2006065519 | A1 | 6/2006 |
| WO | 2006065540 | A1 | 6/2006 |
| WO | WO 2006/065519 | A1 * | 6/2006 |
| WO | 2006104811 | A1 | 10/2006 |
| WO | 2008060738 | A1 | 5/2008 |

OTHER PUBLICATIONS

ASTM D638, Standard Test Method for Tensile Properties of Plastics, Jul. 25, 2007, 15 pages.

ASTM D1238-00, Standard Test Method for Melt Flow Rates of Thermoplastics by Extrusion Plastometer, Feb. 21, 2007, 12 pages.

ASTM D2240-05, Standard Test Method for Rubber Property—Durometer Hardness, Feb. 26, 2007, 13 pages.

UL 94, Tests for Flammability of Plastic Materials for Parts in Devices and Appliances, Dec. 12, 2003, 52 pages.

WO 2004/019349 A1, Publication Date: Mar. 4, 2004, Abstract, 1 page.

EP 675576 A1, Publication Date: Oct. 4, 1995, Abstract, 1 page.

EP 1389784 A1, Publication Date: Feb. 18, 2004, Abstract, 1 page.

International Search Report; International Application No. PCT/IB2008/054866; International Filing Date Nov. 19, 2008; Date of Mailing Jun. 3, 2009; 7 pages.

Written Opinion of the International Searching Authority; International Application No. PCT/IB2008/054866; International Filing Date Nov. 19, 2008; 9 pages.

* cited by examiner

MULTICONDUCTOR CABLE ASSEMBLY AND FABRICATION METHOD THEREFOR

CROSS REFERENCE TO RELATED APPLICATION

This application claims the benefit of U.S. Provisional Patent Application Ser. No. 60/990,325 filed Nov. 27, 2007, which is fully incorporated herein by reference.

BACKGROUND OF THE INVENTION

Multiconductor cable assemblies, sometimes called ribbon cables or flat conductor cables, have become commonplace in electrical devices for power and signal transmission between various components within such devices and between such devices. Multiconductor cable assemblies are generally preferred in wiring technology particularly because of their low height and weight, which is essentially determined only by the height and weight of the conductors. Multiconductor cable assemblies by their nature take up little space and are flexible. Due to their good electrical and mechanical properties and low space requirements, they are useful for wiring public utility apparatuses, for power and signal transmission between fixed and movable parts of motor vehicles, and in office automation apparatuses.

A commonly used electrically insulating material for multiconductor cable assemblies is poly(vinyl chloride) (PVC). It is relatively inexpensive, widely available, flexible, and has natural flame resistant properties. There is an increasing desire to reduce or eliminate the use of halogenated resins in insulating layers due to their negative impact on the environment. In fact, many countries are beginning to mandate a decrease in the use of halogenated materials such as PVC. Therefore there is a continuing need to develop new multiconductor cable assemblies wherein the electrical insulation material, i.e. covering, in the assembly is not PVC or another halogen-based material.

Recent research has demonstrated that certain halogen-free poly(arylene ether) compositions can possess the physical and flame retardant properties needed for use as wire and cable insulation. See, for example, U.S. Patent Application Publication Nos. US 2006/0106139 A1 and US 2006/0182967 A1 of Kosaka et al. And certain poly(arylene ether) compositions have been disclosed as suitable for fabrication of multiconductor cable assemblies. See, for example, U.S. Patent Application Publication No. US 2006/0131059 A1 of Xu et al. However, the poly(arylene ether) compositions of Xu et al. require for high flame retardant loadings and exhibit heat deformation performance that is inadequate for some applications. Furthermore, the solvent welding method demonstrated in the working examples of Xu et al. has the disadvantage of requiring the handling and disposal of welding solvents, which are volatile organic compounds.

There remains a need for multiconductor cable assemblies and associated fabrication methods that avoid the use of halogenated polymers, allow for lower flame retardant loadings in the covering composition, exhibit improved heat deformation performance, and avoid the use of welding solvents.

BRIEF DESCRIPTION OF THE INVENTION

The above-described and other drawbacks are alleviated by a multiconductor cable assembly comprising two or more coated wires arranged in a side-by-side contiguous relation providing one or more interfacing contact areas between adjacent coated wires; wherein each of the two or more coated wires comprises a conductor, and a covering comprising a thermoplastic composition comprising 20 to 50 weight percent of a poly(arylene ether), 30 to 50 weight percent of a block copolymer comprising a poly(alkenyl aromatic) block and a polyolefin block, 5 to 25 weight percent of a flame retardant, and 0 to 10 weight percent of a polyolefin; wherein all weight percents are based on the total weight of the thermoplastic composition; and wherein the thermoplastic composition exhibits a flexural modulus of 50 to 1,000 megapascals, measured at 23° C. according to ASTM D790.

Another embodiment is a method of forming a multiconductor cable assembly, comprising arranging two or more uncoated conductors, each having a diameter of 0.2546 to 0.8128 millimeter, in a side-by-side relationship in which the uncoated conductors are essentially parallel to each other and spaced relative to each other by a center-to-center distance of at least 1.5 times the diameter of the uncoated conductors; and extrusion coating the two or more temperature-adjusted uncoated conductors with a thermoplastic composition having a temperature of 230 to 290° C. to form the multiconductor cable assembly; wherein the extrusion coating is conducted at a line speed of 3 to 10 meters per minute; and wherein the thermoplastic composition comprises 20 to 50 weight percent of a poly(arylene ether), 30 to 50 weight percent of a block copolymer comprising a poly(alkenyl aromatic) block and a polyolefin block, 5 to 25 weight percent of a flame retardant, and 0 to 10 weight percent of a polyolefin; wherein all weight percents are based on the total weight of the thermoplastic composition; and wherein the thermoplastic composition exhibits a flexural modulus of 50 to 1,000 megapascals, measured at 23° C. according to ASTM D790.

Another embodiment is a method of forming a multiconductor cable assembly, comprising: arranging two or more coated wires in a side-by-side contiguous relationship to provide contact areas between adjacent coated wires; adjusting the surface temperature of the two or more coated wires to 150 to 180° C.; and passing the temperature-adjusted coated wires through a nip defined by two rollers to form the multiconductor cable assembly, wherein each roller independently has a surface temperature of 180 to 220° C.; wherein the multiconductor cable assembly has a surface temperature of 145 to 210° C. as it exits the nip; wherein the two or more coated wires each comprise a conductor having a diameter $D_1$ and a covering disposed on the conductor and having an outer diameter $D_2$, and wherein the nip is $1.1\times D_1$ to $1.1\times D_2$; wherein the passing the temperature-adjusted coated wires through a nip is conducted at a line speed of 3 to 10 meters per minute; and wherein the thermoplastic composition comprises 20 to 50 weight percent of a poly(arylene ether), 30 to 50 weight percent of a block copolymer comprising a poly (alkenyl aromatic) block and a polyolefin block, 5 to 25 weight percent of a flame retardant, and 0 to 10 weight percent of a polyolefin, wherein all weight percents are based on the total weight of the thermoplastic composition; and wherein the thermoplastic composition exhibits a flexural modulus of 50 to 1,000 megapascals, measured at 23° C. according to ASTM D790.

These and other embodiments are described in detail below.

BRIEF DESCRIPTION OF THE DRAWINGS

Referring now to the drawings wherein like elements are numbered alike in several FIGURES.

DETAILED DESCRIPTION OF THE INVENTION

Figure 1:
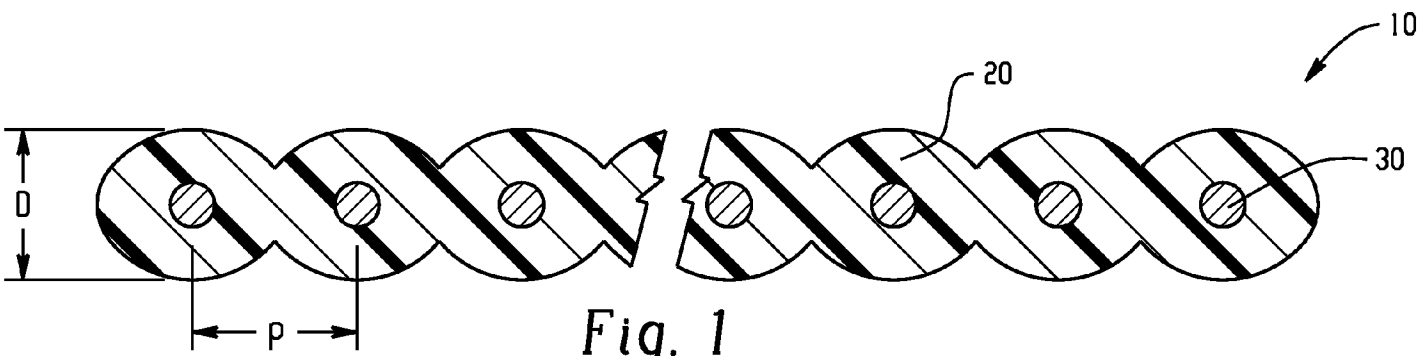
FIG. 1 is a cross-sectional view of a multiconductor cable assembly, with the diameter, D, of individual coated wires and the pitch (center-to-center distance between wires), P, indicated.

The present inventors have conducted research on methods of fabricating multiconductor cable assemblies using poly (arylene ether) compositions. In the course of this research, they have discovered that multiconductor cable assemblies having excellent physical and flame retardant properties can be fabricated using a thermoplastic composition comprising particular amounts of a poly(arylene ether), a block copolymer comprising a poly(alkenyl aromatic) block and a polyolefin block, a flame retardant, and, optionally, a small amount of polyolefin. The multiconductor cable assemblies can be fabricated in a so-called one-step process in which an array of uncoated conductors is coated with the thermoplastic composition, and a so-called two-step process in which uncoated conductors are first individually coated with the thermoplastic composition, then the resulting coated (insulated) wires are heat welded to form the multiconductor cable assembly. The present methods avoid the use of halogenated polymers, allow for lower flame retardant loadings in the covering composition, exhibit improved heat deformation performance, and avoid the use of welding solvents.

One embodiment is a multiconductor cable assembly comprising two or more coated wires arranged in a side-by-side contiguous relation providing one or more interfacing contact areas between adjacent coated wires; wherein each of the two or more coated wires comprises a conductor, and a covering comprising a thermoplastic composition comprising 20 to 50 weight percent of a poly(arylene ether), 30 to 50 weight percent of a block copolymer comprising a poly(alkenyl aromatic) block and a polyolefin block, 5 to 25 weight percent of a flame retardant, and 0 to 10 weight percent of a polyolefin; wherein all weight percents are based on the total weight of the thermoplastic composition; and wherein the thermoplastic composition exhibits a flexural modulus of 50 to 1,000 megapascals, specifically 100 to 900 megapascals, more specifically 100 to 800 megapascals, still more specifically 100 to 700 megapascals, measured at 23° C. according to ASTM D790.

The multiconductor cable assembly comprises two or more coated wires, with each coated wire comprising a conductor and a covering. The conductor may comprise a single strand or a plurality of strands. In some embodiments, a plurality of strands may be bundled, twisted, or braided to form a conductor. Additionally, the conductor may have various shapes such as round or oblong. Suitable conductors include, but are not limited to, copper wire, aluminum wire, lead wire, and wires of alloys comprising one or more of the foregoing metals. The conductor may also be coated with, for example, tin or silver. In some embodiments, the conductor may comprise one or more conductive wires, one or more metal foils, one or more conductive inks, or a combination thereof. There is no particular limitation on the size of the conductor. In some embodiments, the conductor size is specified as American Wire Gauge (AWG) 30 to AWG 20, corresponding to a conductor diameter of 0.2546 to 0.8128 millimeter. In these embodiments, the covering of the coated wires will typically have a thickness of 0.1 to 0.5 millimeter, specifically 0.15 to 0.4 millimeter, more specifically 0.2 to 0.3 millimeter. In other embodiments, the conductor diameter can be as small as 0.05 millimeter, or as large as 0.85 millimeter. In some embodiments, the conduct size can be as small as AWG 40.

FIG. 1 is a cross-sectional view of an exemplary multiconductor cable assembly 10 in which a covering 20 is disposed on a plurality of conductors 30 arranged in a side-by-side relationship, such that the centers of the conductors lie along a single line or plane. The multiconductor cable assembly comprises at least two coated wires. In some embodiments, the multiconductor cable assembly comprises 10 to 100 coated wires, specifically 20 to 50 coated wires, more specifically 20 to 40 coated wires.

Figure 2:
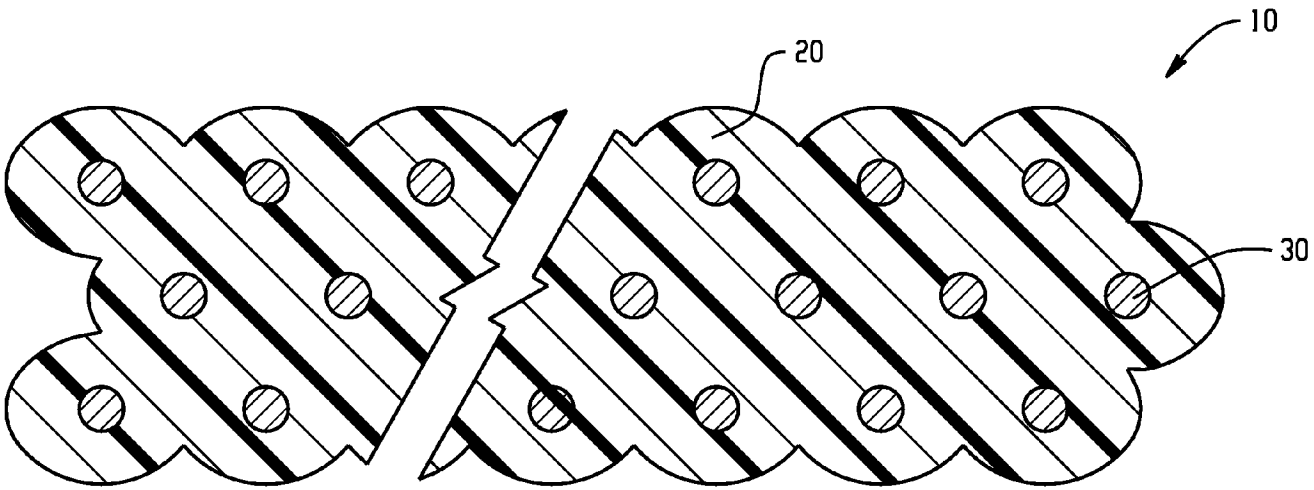
FIG. 2 is a cross-sectional view of a multiconductor cable assembly comprising three rows of conductors.

FIG. 2 is a cross-sectional view of another exemplary multiconductor cable assembly 10. In this embodiment, the cable assembly 10 comprises three rows of coated wires, each coated wire comprising a covering 20 disposed on a plurality of conductors 30.

The thermoplastic composition used to form the covering of the coated wire comprises a poly(arylene ether), a block copolymer comprising a poly(alkenyl aromatic) block and a polyolefin block, and a flame retardant.

Suitable poly(arylene ether)s include those comprising repeating structural units having the formula

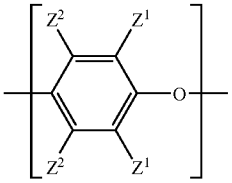

wherein each occurrence of $Z^1$ is independently halogen, unsubstituted or substituted $C_1$-$C_{12}$ hydrocarbyl provided that the hydrocarbyl group is not tertiary hydrocarbyl, $C_1$-$C_{12}$ hydrocarbylthio, $C_1$-$C_{12}$ hydrocarbyloxy, or $C_2$-$C_{12}$ halohydrocarbyloxy wherein at least two carbon atoms separate the halogen and oxygen atoms; and each occurrence of $Z^2$ is independently hydrogen, halogen, unsubstituted or substituted $C_1$-$C_{12}$ hydrocarbyl provided that the hydrocarbyl group is not tertiary hydrocarbyl, $C_1$-$C_{12}$ hydrocarbylthio, $C_1$-$C_{12}$ hydrocarbyloxy, or $C_2$-$C_{12}$ halohydrocarbyloxy wherein at least two carbon atoms separate the halogen and oxygen atoms. As used herein, the term "hydrocarbyl", whether used by itself, or as a prefix, suffix, or fragment of another term, refers to a residue that contains only carbon and hydrogen. The residue can be aliphatic or aromatic, straight-chain, cyclic, bicyclic, branched, saturated, or unsaturated. It can also contain combinations of aliphatic, aromatic, straight chain, cyclic, bicyclic, branched, saturated, and unsaturated hydrocarbon moieties. However, when the hydrocarbyl residue is described as substituted, it may, optionally, contain heteroatoms over and above the carbon and hydrogen members of the substituent residue. Thus, when specifically described as substituted, the hydrocarbyl residue may also contain one or more carbonyl groups, amino groups, hydroxyl groups, or the like, or it may contain heteroatoms within the backbone of the hydrocarbyl residue. As one example, $Z^1$ may be a di-n-butylaminomethyl group formed by reaction of a terminal 3,5-dimethyl-1,4-phenyl group with the di-n-butylamine component of an oxidative polymerization catalyst.

In some embodiments, the poly(arylene ether) comprises 2,6-dimethyl-1,4-phenylene ether units, 2,3,6-trimethyl-1,4-phenylene ether units, or a combination thereof. In some embodiments, the poly(arylene ether) is a poly(2,6-dimethyl-1,4-phenylene ether).

The poly(arylene ether) can comprise molecules having aminoalkyl-containing end group(s), typically located in a position ortho to the hydroxy group. Also frequently present are tetramethyldiphenoquinone (TMDQ) end groups, typically obtained from 2,6-dimethylphenol-containing reaction mixtures in which tetramethyldiphenoquinone by-product is present. The poly(arylene ether) can be in the form of a homopolymer, a copolymer, a graft copolymer, an ionomer, or a block copolymer, as well as combinations comprising at least one of the foregoing.

In some embodiments, the poly(arylene ether) has an intrinsic viscosity of 0.1 to 1 deciliter per gram measured at 25° C. in chloroform. Specifically, the poly(arylene ether) intrinsic viscosity may be 0.2 to 0.8 deciliter per gram, more specifically 0.3 to 0.6 deciliter per gram, still more specifically 0.4 to 0.5 deciliter per gram.

The thermoplastic composition comprises 20 to 50 weight percent of a poly(arylene ether), based on the total weight of the thermoplastic composition. Within this range, the poly (arylene ether) amount can be 25 to 45 weight percent, more specifically 25 to 40 weight percent.

In addition to the poly(arylene ether), the thermoplastic composition comprises a block copolymer comprising a poly (alkenyl aromatic) block and a polyolefin block. In some embodiments, the polyolefin block is a poly(conjugated diene) or a hydrogenated poly(conjugated diene). The block copolymer may comprise 15 to 80 weight percent of poly (alkenyl aromatic) content and 20 to 85 weight percent of polyolefin content. In some embodiments, the poly(alkenyl aromatic) content is 20 to 40 weight percent. In other embodiments, the poly(alkenyl aromatic) content is greater than 40 weight percent to 90 weight percent, specifically 55 to 80 weight percent.

In some embodiments, the block copolymer has a weight average molecular weight of 3,000 to 400,000 atomic mass units. The number average molecular weight and the weight average molecular weight can be determined by gel permeation chromatography and based on comparison to polystyrene standards. In some embodiments, the block copolymer has a weight average molecular weight of 40,000 to 400,000 atomic mass units, specifically 200,000 to 400,000 atomic mass units, more specifically 220,000 to 350,000 atomic mass units. In other embodiments, the block copolymer has a weight average molecular weight of 40,000 to less than 200,000 atomic mass units, specifically 40,000 to 180,000 atomic mass units, more specifically 40,000 to 150,000 atomic mass units.

The alkenyl aromatic monomer used to prepare the block copolymer can have the structure

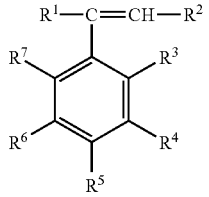

wherein $R^1$ and $R^2$ each independently represent a hydrogen atom, a $C_1$-$C_8$ alkyl group, or a $C_2$-$C_8$ alkenyl group; $R^3$ and $R^7$ each independently represent a hydrogen atom, or a $C_1$-$C_8$ alkyl group; and $R^4$, $R^5$, and $R^6$ each independently represent a hydrogen atom, a $C_1$-$C_8$ alkyl group, or a $C_2$-$C_8$ alkenyl group, or $R^3$ and $R^4$ are taken together with the central aromatic ring to form a naphthyl group, or $R^4$ and $R^5$ are taken together with the central aromatic ring to form a naphthyl group. Specific alkenyl aromatic monomers include, for example, styrene and methylstyrenes such as alpha-methylstyrene and p-methylstyrene. In some embodiments, the alkenyl aromatic monomer is styrene.

The conjugated diene used to prepare the block copolymer can be a $C_4$-$C_{20}$ conjugated diene. Suitable conjugated dienes include, for example, 1,3-butadiene, 2-methyl-1,3-butadiene, 2-chloro-1,3-butadiene, 2,3-dimethyl-1,3-butadiene, 1,3-pentadiene, 1,3-hexadiene, and the like, and combinations thereof. In some embodiments, the conjugated diene is 1,3-butadiene, 2-methyl-1,3-butadiene, or a combination thereof. In some embodiments, the conjugated diene consists of 1,3-butadiene.

The block copolymer is a copolymer comprising (A) at least one block derived from an alkenyl aromatic compound and (B) at least one block derived from a conjugated diene. In some embodiments, the aliphatic unsaturation in the (B) block is reduced at least 50 percent, specifically at least 70 percent, by hydrogenation. The arrangement of blocks (A) and (B) includes a linear structure, a grafted structure, and a radial teleblock structure with or without a branched chain. Linear block copolymers include tapered linear structures and non-tapered linear structures. In some embodiments, the block copolymer has a tapered linear structure. In some embodiments, the block copolymer has a non-tapered linear structure. In some embodiments, the block copolymer comprises a B block that comprises random incorporation of alkenyl aromatic monomer. Linear block copolymer structures include diblock (A-B block), triblock (A-B-A block or B-A-B block), tetrablock (A-B-A-B block), and pentablock (A-B-A-B-A block or B-A-B-A-B block) structures as well as linear structures containing 6 or more blocks in total of A and B, wherein the molecular weight of each A block may be the same as or different from that of other A blocks, and the molecular weight of each B block may be the same as or different from that of other B blocks. In some embodiments, the block copolymer is a diblock copolymer, a triblock copolymer, or a combination thereof. In some embodiments, the block copolymer is a polystyrene-poly(ethylene-butylene)-polystyrene triblock copolymer.

In some embodiments, the block copolymer excludes the residue of monomers other than the alkenyl aromatic compound and the conjugated diene. In some embodiments, the block copolymer consists of blocks derived from the alkenyl aromatic compound and the conjugated diene. In these embodiments it does not comprise grafts formed from these or any other monomers; it also consists of carbon and hydrogen atoms and therefore excludes heteroatoms.

In other embodiments, the block copolymer includes the residue of one or more acid functionalizing agents, such as maleic anhydride.

Methods of preparing block copolymers are known in the art and many hydrogenated block copolymers are commercially available. Illustrative commercially available hydrogenated block copolymers include the polystyrene-poly(ethylene-propylene)diblock copolymers available from Kraton Polymers as Kraton G1701 and G1702; the polystyrene-poly(ethylene-butylene)-polystyrene triblock copolymers available from Kraton Polymers as Kraton G1641, G1650, G1651, G1654, G1657, G1726, G4609, G4610, GRP-6598, RP-6924, MD-6932M, MD-6933, and MD-6939; the polystyrene-poly(ethylene-butylene-styrene)-polystyrene (S-EB/S-S) triblock copolymers available from Kraton Polymers as Kraton RP-6935 and RP-6936, the polystyrene-poly(ethylene-propylene)-polystyrene triblock copolymers available from Kraton Polymers as Kraton G1730; the maleic anhydride-grafted polystyrene-poly(ethylene-butylene)-polystyrene triblock copolymers available from Kraton Polymers as Kraton GI 901, G1924, and MD-6684; the maleic anhydride-grafted polystyrene-poly(ethylene-butylene-styrene)-polystyrene triblock copolymer available from Kraton Polymers as Kraton MD-6670; the polystyrene-poly(ethylene-butylene)-polystyrene triblock copolymer comprising 67 weight percent polystyrene available from Asahi Kasei Elastomer as TUFTEC H1043; the polystyrene-poly(ethylene-butylene)-polystyrene triblock copolymer comprising 42 weight percent polystyrene available from Asahi Kasei Elastomer as TUFTEC H1051; the polystyrene-poly(butadiene-butylene)-polystyrene triblock copolymers available from Asahi Kasei Elastomer as TUFTEC P1000 and P2000; the polystyrene-polybutadiene-poly(styrene-butadiene)-polybutadiene block copolymer available from Asahi Kasei Elastomer as S.O.E.-SS L601; the polystyrene-poly(ethylene-butylene)-polystyrene triblock copolymer comprising about 60 weight polystyrene available from Kuraray as SEPTON S8104; the polystyrene-poly(ethylene-ethylene/propylene)-polystyrene triblock copolymers available from Kuraray as SEPTON S4044, S4055, S4077, and S4099; and the polystyrene-poly(ethylene-propylene)-polystyrene triblock copolymer comprising about 65 weight percent polystyrene available from Kuraray as SEPTON S2104. Mixtures of two of more block copolymers may be used. Illustrative commercially available unhydrogenated block copolymers include the KRATON® D series polymers, including KRATON® D1101 and D1102, from Kraton Polymers; the styrene-butadiene radial teleblock copolymers available as, for example, K-RESIN IR01, KR03, KR05, and KR10 sold by Chevron Phillips Chemical Company; and the tapered block copolymers are commercially available as, for example, FINACLEAR® 520 and 540 from Total Petrochemicals.

The thermoplastic composition can comprise the block copolymer in an amount of 30 to 50 weight percent, specifically 35 to 45 weight percent, based on the total weight of the thermoplastic composition.

In addition to the poly(arylene ether) and the block copolymer, the thermoplastic composition comprises a flame retardant. Suitable flame retardants include, for example, triaryl phosphates (such as triphenyl phosphate, alkylated triphenyl phosphates, resorcinol bis(diphenyl phosphate), resorcinol bis(di-2,6-xylyl phosphate), and bisphenol A bis(diphenyl phosphate)), metal phosphinates (such as aluminum tris(diethyl phosphinate)), melamine salts (such as melamine cyanurate, melamine phosphate, melamine pyrophosphate, and melamine polyphosphate), metal borate salts (such as zinc borate), metal hydroxides (such as magnesium hydroxide and aluminum hydroxide), and combinations thereof.

The thermoplastic composition can comprise the flame retardant in an amount of 5 to 25 weight percent, specifically 10 to 20 weight percent, based on the total weight of the thermoplastic composition.

In addition to the poly(arylene ether), the block copolymer, and the flame retardant, the thermoplastic composition can, optionally, further comprises up to 10 weight percent of a polyolefin. As used herein to describe a complete polymer (as opposed to a block within a block copolymer), the term "polyolefin" refers to homopolymers and copolymers of $C_2$-$C_{12}$ alkenes, wherein the term "alkene" refers to an aliphatic hydrocarbon having one or more aliphatic double bonds. The term "polyolefin" therefore excludes copolymers of monomers comprising alkenyl aromatic compounds, such as styrene.

In some embodiments, the polyolefin comprises an olefin homopolymer. Exemplary olefin homopolymers include polyethylene, high density polyethylene (HDPE), medium density polyethylene (MDPE), and isotactic polypropylene.

In some embodiments, the polyolefin comprises an olefin copolymer. Illustrative olefin copolymers include copolymers of ethylene and alpha olefins like 1-octene, propylene and 4-methyl-1-pentene as well as copolymers of ethylene and one or more rubbers, and copolymers of propylene and one or more rubbers. Olefin copolymers further include copolymers of two or more olefin isomers, such as copolymers of two or more of 1-butene, 2-butene, and isobutene (2-methylpropene). Copolymers of ethylene and $C_3$-$C_{10}$ monoolefins and non-conjugated dienes, herein referred to as EPDM copolymers, are also suitable olefin copolymers. Examples of suitable $C_3$-$C_{10}$ monoolefins for EPDM copolymers include propylene, 1-butene, 2-butene, 1-pentene, 2-pentene, 1-hexene, 2-hexene, 3-hexene, and the like. Suitable dienes include 1,4-hexadiene and monocyclic and polycyclic dienes. Mole ratios of ethylene to other $C_3$-$C_{10}$ monoolefin monomers can range from 95:5 to 5:95 with diene units being present in the amount of from 0.1 to 10 mole percent. EPDM copolymers can be functionalized with an acyl group or electrophilic group for grafting onto the polyphenylene ether as disclosed in U.S. Pat. No. 5,258,455 to Laughner et al. Olefin copolymers further include linear low density polyethylene (LLDPE).

The thermoplastic composition can comprise the polyolefin in an amount of 0 to 10 weight percent, specifically 1 to 8 weight percent, more specifically 2 to 8 weight percent, based on the total weight of the thermoplastic composition.

In some embodiments, the thermoplastic composition comprises a polyolefin consisting of a polybutene. In this embodiment, the phrase "a polyolefin consisting of a polybutene" means that the thermoplastic composition excludes any polyolefin that is not a polybutene. The polybutene amount can be 1 to 10 weight percent, specifically 2 to 5 weight percent, more specifically 2 to 6 weight percent, based on the total weight of the thermoplastic composition.

In some embodiment, the thermoplastic composition excluded polyethylenes and polypropylenes. As used herein, the term "polyethylenes" refers to homopolymers of ethylene and copolymers of 80 to 99.9 weight percent ethylene and 0.1 to 20 weight percent of one or more alkenes other than ethylene. In the context of ethylene copolymers, the "other alkenes" include monoenes (such as, for example, propylene, butenes, pentenes, hexenes, heptenes, and octenes), and dienes (such as, for example, ethylidene norbornene), but exclude alkenyl aromatic compounds (such as, for example, styrene). In some embodiments, the composition excludes polyethylenes. In some embodiments, the composition excludes ethylene homopolymers. As used herein, the term "polypropylenes" refers to homopolymers of propylene and copolymers of 80 to 99.9 weight percent propylene and 0.1 to 20 weight percent of one or more alkenes other than propylene. In the context of propylene copolymers, the "other alkenes" include monoenes (such as, for example, ethylene, butenes, pentenes, hexenes, heptenes, and octenes), and dienes (such as, for example, ethylidene norbornene), but exclude alkenyl aromatic compounds (such as, for example, styrene). In some embodiments, the composition excludes polypropylenes. In some embodiments, the composition excludes propylene homopolymers. In some embodiments, the thermoplastic composition excludes ethylene homopolymers and propylene homopolymers.

The thermoplastic composition may, optionally, further comprise various additives known in the thermoplastics art. For example, the thermoplastic composition may, optionally, further comprise an additive chosen from stabilizers, mold release agents, processing aids, drip retardants, nucleating agents, UV blockers, dyes, pigments, antioxidants, anti-static agents, blowing agents, mineral oil, metal deactivators, anti-blocking agents, nanoclays, and the like, and combinations thereof.

In some embodiments, the thermoplastic composition excludes any polymer not described herein as required or optional. In some embodiments, the thermoplastic composition excludes fillers.

As the thermoplastic composition is defined as comprising multiple components, it will be understood that each component is chemically distinct, particularly in the instance that a single chemical compound may satisfy the definition of more than one component.

In a very specific embodiment, the thermoplastic composition comprises 30 to 36 weight percent poly(2,6-dimethyl-1,4-phenylene ether), 5 to 11 weight percent polypropylene, 8 to 16 weight percent of a thermoplastic elastomer (e.g., the thermoplastic elastomer containing polystyrene-poly(ethylene-butylene)-polystyrene)triblock copolymer, polystyrene-poly(ethylene-propylene)-polystyrene)triblock copolymer, propylene homopolymer, ethylene-propylene copolymer, mineral oil, and calcium carbonate available as Sumitomo TPE-SB 2400 from Sumitomo Chemical Co., Ltd.), 3 to 7 weight percent polybutene, 25 to 35 weight percent polystyrene-poly(ethylene-butylene)-polystyrene) triblock copolymer, 1 to 3 weight percent melamine polyphosphate, 1 to 3 weight percent aluminum tris(diethyl phosphinate), and 5 to 11 weight percent bisphenol A bis(diphenyl phosphate), wherein all weight percents are based on the total weight of the thermoplastic composition.

The preparation of the compositions of the present invention is normally achieved by melt blending the ingredients under conditions for the formation of an intimate blend. Such conditions often include mixing in single-screw or twin-screw type extruders or similar mixing devices that can apply a shear to the components. In some embodiments, the thermoplastic composition can be compounded as part of the multiconductor cable assembly fabrication method. In other embodiments, the thermoplastic composition is compounded and, typically, pelletized in an operation that is separate from the multiconductor cable assembly fabrication method.

In some embodiments, the thermoplastic composition comprises 20 to 40 weight percent of a poly(2,6-dimethyl-1,4-phenylene ether) having an intrinsic viscosity of 0.3 to 0.6 deciliter per gram measured at 25° C. in chloroform, 30 to 50 weight percent of a triblock copolymer selected from the group consisting of polystyrene-poly(ethylene-butylene)-polystyrene triblock copolymers, polystyrene-poly(ethylene-butylene-styrene)-polystyrene triblock copolymers, and mixtures thereof, 2 to 6 weight percent of a polybutene, and 10 to 20 weight percent of a flame retardant selected from the group consisting of triaryl phosphates, melamine polyphosphates, metal phosphinates, magnesium hydroxides, and mixtures thereof; and the thermoplastic composition exhibits a flexural modulus of 100 to 800 megapascals, measured at 23° C. according to ASTM D790, a tensile strength of 10 to 35 megapascals measured at 23° C. according to ASTM D638, a tensile elongation at break of 50 to 200 percent, measured at 23° C. according to ASTM D638, and a passing flame test rating according to UL 1581, Section 1080 measured on a test sample coated wire consisting of an AWG 28 conductor having a nominal diameter of 0.318 millimeter and a tubular covering comprising the thermoplastic composition and having a nominal outer diameter of 1.075 millimeters.

Although not required for many applications, in some embodiments the thermoplastic composition further exhibits a UL 94 Vertical Burning Flame Test rating of V-0 at a sample thickness of 6 millimeters.

The invention extends to methods of forming multiconductor cable assemblies. For example, one embodiments is a so-called one-step method of forming a multiconductor cable assembly, comprising arranging two or more uncoated conductors, each having a diameter of 0.2546 to 0.8128 millimeter, in a side-by-side relationship in which the uncoated conductors are essentially parallel to each other and spaced relative to each other by a center-to-center distance of at least 1.5 times the diameter of the uncoated conductors; and extrusion coating the two or more temperature-adjusted uncoated conductors with a thermoplastic composition having a temperature of 230 to 290° C. to form the multiconductor cable assembly; wherein the extrusion coating is conducted at a line speed of 3 to 10 meters per minute; and wherein the thermoplastic composition comprises 20 to 50 weight percent, specifically 25 to 45 weight percent, more specifically 25 to 40 weight percent of a poly(arylene ether), 30 to 50 weight percent, specifically 35 to 45 weight percent, of a block copolymer comprising a poly(alkenyl aromatic) block and a polyolefin block, and 5 to 25 weight percent, specifically 10 to 20 weight percent, of a flame retardant, and 0 to 10 weight percent, specifically 1 to 8 weight percent, more specifically 2 to 5 weight percent, of a polyolefin; wherein all weight percents are based on the total weight of the thermoplastic composition; and wherein the thermoplastic composition exhibits a flexural modulus of 50 to 1,000 megapascals, specifically 100 to 900 megapascals, more specifically 100 to 800 megapascals, still more specifically 100 to 700 megapascals, measured at 23° C. according to ASTM D790. The present inventors have observed that the thermoplastic composition temperature of 230 to 290° C. is critical. At temperatures below 230° C., the thermoplastic composition is insufficiently fluid and the surface of the resulting cable is poor. At temperatures above 290° C., decomposition of the thermoplastic composition can occur, with generation of undesirable odors. Note that poly(vinyl chloride) coverings are formed at a much lower temperature range of about 160 to 180° C. The line speed range of 3 to 10 meters per minute is also critical in that line speeds below 3 meters per minute subject the thermoplastic composition to unacceptably long periods at elevated temperature (as well as reducing productivity), and line speeds above 10 meters per minute result in poor surface quality of the resulting cable. This embodiment can, optionally, further comprise adjusting (preheating) the two or more uncoated conductors to a temperature of 80 to 150° C., specifically 80 to 120° C., before the extrusion coating step. In the embodiment, the thermoplastic composition can, optionally, comprise 1 to 10 weight percent, specifically 2 to 8 weight percent, more specifically 2 to 6 weight percent, of a polyolefin consisting of a polybutene. Also in this embodiment, the flame retardant can, optionally, be selected from triaryl phosphates, metal phosphinates, melamine salts, metal borate salts, metal hydroxides, and combinations thereof. Also in this embodiment, the thermoplastic composition can, optionally, exclude ethylene homopolymers and propylene homopolymers. Also in this embodiment, the method can, optionally, further comprise cooling the extrusion coated wires, as for example, in a water bath.

In a specific embodiment of the one-step method described above, the thermoplastic composition comprises 20 to 40 weight percent of a poly(2,6-dimethyl-1,4-phenylene ether) having an intrinsic viscosity of 0.3 to 0.6 deciliter per gram measured at 25° C. in chloroform, 30 to 50 weight percent of a triblock copolymer selected from the group consisting of polystyrene-poly(ethylene-butylene)-polystyrene triblock copolymers, polystyrene-poly(ethylene-butylene-styrene)-polystyrene triblock copolymers, and mixtures thereof, 2 to 6 weight percent of a polybutene, and 10 to 20 weight percent of a flame retardant selected from triaryl phosphates, melamine polyphosphates, metal phosphinates, magnesium hydroxides, and mixtures thereof; and the thermoplastic composition exhibits a flexural modulus of 100 to 800 megapascals, measured at 23° C. according to ASTM D790, a tensile strength of 10 to 35 megapascals measured at 23° C. according to ASTM D638, a tensile elongation at break of 50 to 200 percent, measured at 23° C. according to ASTM D638, and a passing flame test rating according to UL 1581, Section 1080 measured on a test sample coated wire consisting of an AWG 28 conductor having a nominal diameter of 0.318 millimeter and a tubular covering comprising the thermoplastic composition and having a nominal outer diameter of 1.075 millimeters. The thermoplastic composition can, optionally, further exhibit a UL 94 Vertical Burning Flame Test rating of V-0 at a sample thickness of 6 millimeters.

Figure 3:
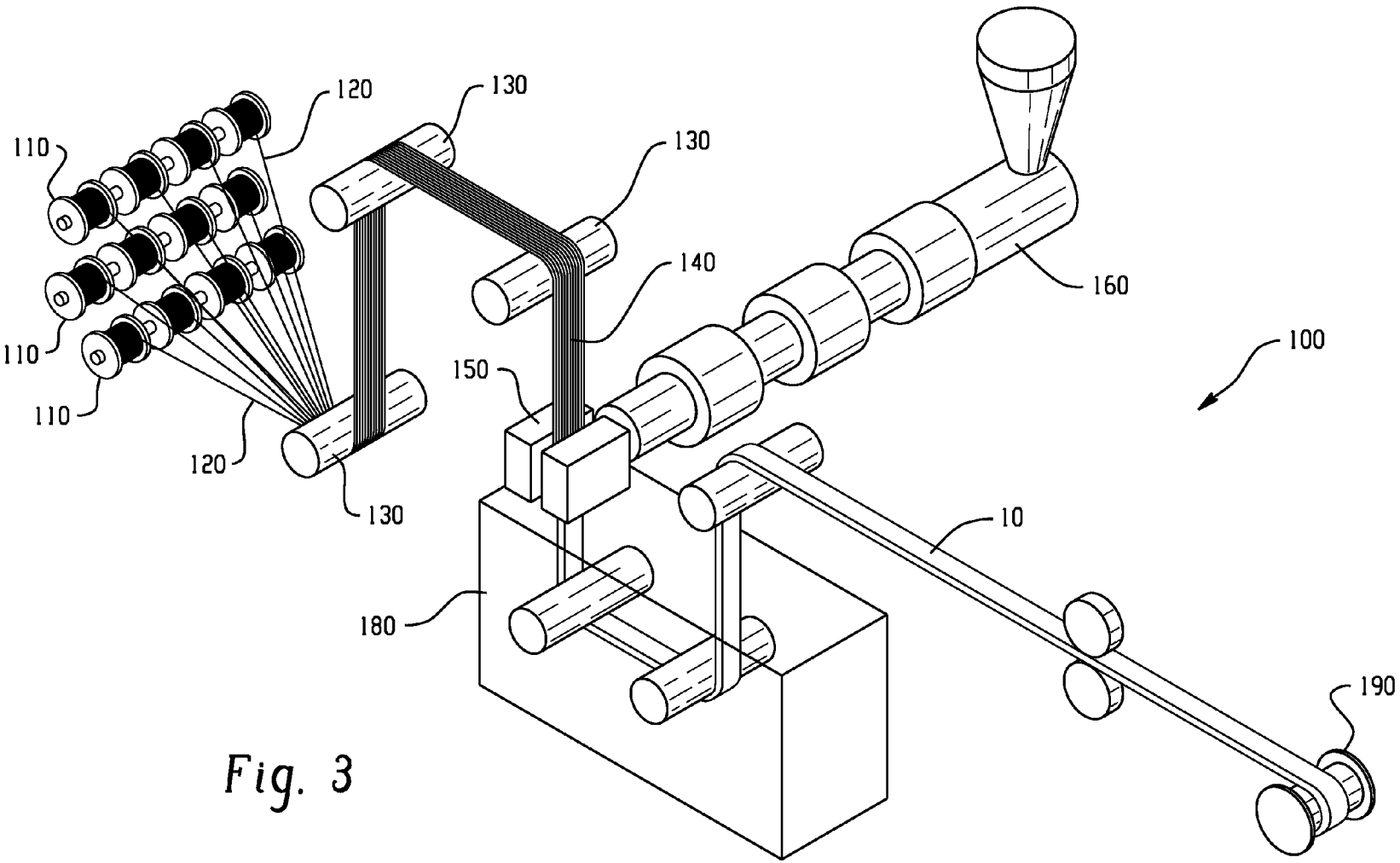
FIG. 3 is a pictorial representation of an apparatus for forming a multiconductor cable assembly from uncoated conductors.

Apparatus adaptable for conducting the one-step method is described, for example, in U.S. Pat. No. 3,728,424 to Bauer, U.S. Pat. No. 4,150,929 to Brandt, U.S. Pat. No. 4,295,812 to Hoddinott, U.S. Pat. No. 4,478,778 to Look, U.S. Pat. No. 4,783,579 to Brandolf et al., U.S. Pat. No. 6,954,983 B2 to Froschl et al., and European Patent Application Publication No. EP 938,099 A1 of Watanabe et al. FIG. 3 is a pictorial representation of an apparatus 100 for conducting the one-step method. The apparatus 100 comprises a plurality of uncoated conductor bobbins 110, each feeding an uncoated conductor strand 120 to rollers 130 where the uncoated conductor strands 120 are aligned in parallel fashion with a predetermined distance between adjacent conductor strands 120. The aligned conductor strands 140 are transported to an extruder 150 and specifically through die 160 of the extruder, where they are extrusion coated with thermoplastic composition to form the multiconductor cable assembly 10. The newly form multiconductor cable assembly 10 is transported through a water bath 180, where it is cooled, and wound onto a receiving reel 190.

Another embodiment is a so-called two-step method of forming a multiconductor cable assembly, comprising: arranging two or more coated wires in a side-by-side contiguous relationship to provide contact areas between adjacent coated wires; adjusting the surface temperature of (preheating) the two or more coated wires to 150 to 180° C., specifically 160 to 180° C.; and passing the temperature-adjusted coated wires through a nip defined by two rollers to form the multiconductor cable assembly, wherein each roller independently has a surface temperature of 180 to 220° C., specifically 190 to 210° C.; wherein the multiconductor cable assembly has a surface temperature of 145 to 210° C., specifically 155 to 200° C., more specifically 165 to 190° C. as it exits the nip; wherein the two or more coated wires each comprise a conductor having a diameter $D_1$ and a covering disposed on the conductor and having an outer diameter $D_2$, and wherein the nip is $1.1\times D_1$ to $1.1\times D_2$, specifically $1.3\times D_1$ to $0.9\times D_2$, more specifically $1.5\times D_1$ to $0.7\times D_2$; wherein the passing the temperature-adjusted coated wires through a nip is conducted at a line speed of 3 to 10 meters per minute; and wherein the thermoplastic composition comprises 20 to 50 weight percent, specifically 25 to 45 weight percent, more specifically 25 to 40 weight percent of a poly(arylene ether), 30 to 50 weight percent, specifically 35 to 45 weight percent of a block copolymer comprising a poly(alkenyl aromatic) block and a polyolefin block, 5 to 25 weight percent, specifically 10 to 20 weight percent of a flame retardant, and 0 to 10 weight percent, specifically 1 to 8 weight percent, more specifically 2 to 8 weight percent of a polyolefin, wherein all weight percents are based on the total weight of the thermoplastic composition; and wherein the thermoplastic composition exhibits a flexural modulus of 50 to 1,000 megapascals, specifically 100 to 900 megapascals, more specifically 100 to 800 megapascals, still more specifically 100 to 700 megapascals, measured at 23° C. according to ASTM D790. The present inventors have observed that roller temperatures in the range of 180 to 220° C. are critical. Roller temperatures below 180° C. lead to poor adhesion between the coated wires, whereas roller temperatures above 220° C. are associated with poor surface characteristics in the resulting cable. The present inventors have also observed that the best results are obtained when the multiconductor cable assembly has a surface temperature of 145 to 210° C. when it exits the nip. Cable surface temperatures below 145° C. are associated with poor surface characteristics, while cable temperatures above 210° C. can lead to detrimental nonuniformities in insulation thickness. Methods for measuring surface temperatures are known in the art and include, for example, non-contact temperature measurement using infrared radiation. In this embodiment, the thermoplastic composition can, optionally, comprise 1 to 10 weight percent, specifically 2 to 8 weight percent, more specifically 2 to 6 weight percent of a polyolefin consisting of a polybutene. Also in this embodiment, the flame retardant can, optionally, be selected from triaryl phosphates, melamine polyphosphates, metal phosphinates, magnesium hydroxides, and mixtures thereof, and combinations thereof. Also in this embodiment, the thermoplastic composition can, optionally, exclude ethylene homopolymers and propylene homopolymers. The method can, optionally, further comprise forming the coated wires by extrusion coating uncoated conductors with the thermoplastic composition (which is the first step of the two step process). The method can, optionally, further comprise cooling the multiconductor cable assembly after it is formed by passage of the temperature-adjusted coated wires through a nip.

In a specific embodiment of the two-step method described above, the thermoplastic composition comprises 20 to 40 weight percent of a poly(2,6-dimethyl-1,4-phenylene ether) having an intrinsic viscosity of 0.3 to 0.6 deciliter per gram measured at 25° C. in chloroform, 30 to 50 weight percent of a triblock copolymer selected from the group consisting of polystyrene-poly(ethylene-butylene)-polystyrene triblock copolymers, polystyrene-poly(ethylene-butylene-styrene)-polystyrene triblock copolymers, and mixtures thereof, 2 to 6 weight percent of a polybutene, and 10 to 20 weight percent of a flame retardant selected from the group consisting of triaryl phosphates, melamine polyphosphates, metal phosphinates, magnesium hydroxides, and mixtures thereof; and the thermoplastic composition exhibits a flexural modulus of 100 to 800 megapascals, measured at 23° C. according to ASTM D790, a tensile strength of 10 to 35 megapascals measured at 23° C. according to ASTM D638, a tensile elongation at break of 50 to 200 percent, measured at 23° C. according to ASTM D638, and a passing flame test rating according to UL 1581, Section 1080 measured on a test sample coated wire consisting of an AWG 28 conductor having a nominal diameter of 0.318 millimeter and a tubular covering comprising the thermoplastic composition and having a nominal outer diameter of 1.075 millimeters. The thermoplastic composition can, optionally, further exhibit a UL 94 Vertical Burning Flame Test rating of V-0 at a sample thickness of 6 millimeters.

Methods of forming individual coated wires comprising a covering comprising a poly(arylene ether) composition are described, for example, in U.S. Patent Application Publication No. US 2006/0191706 A1 of Mhetar et al. Forming individual coated wires is the first step of the two-step method.

Figure 4:
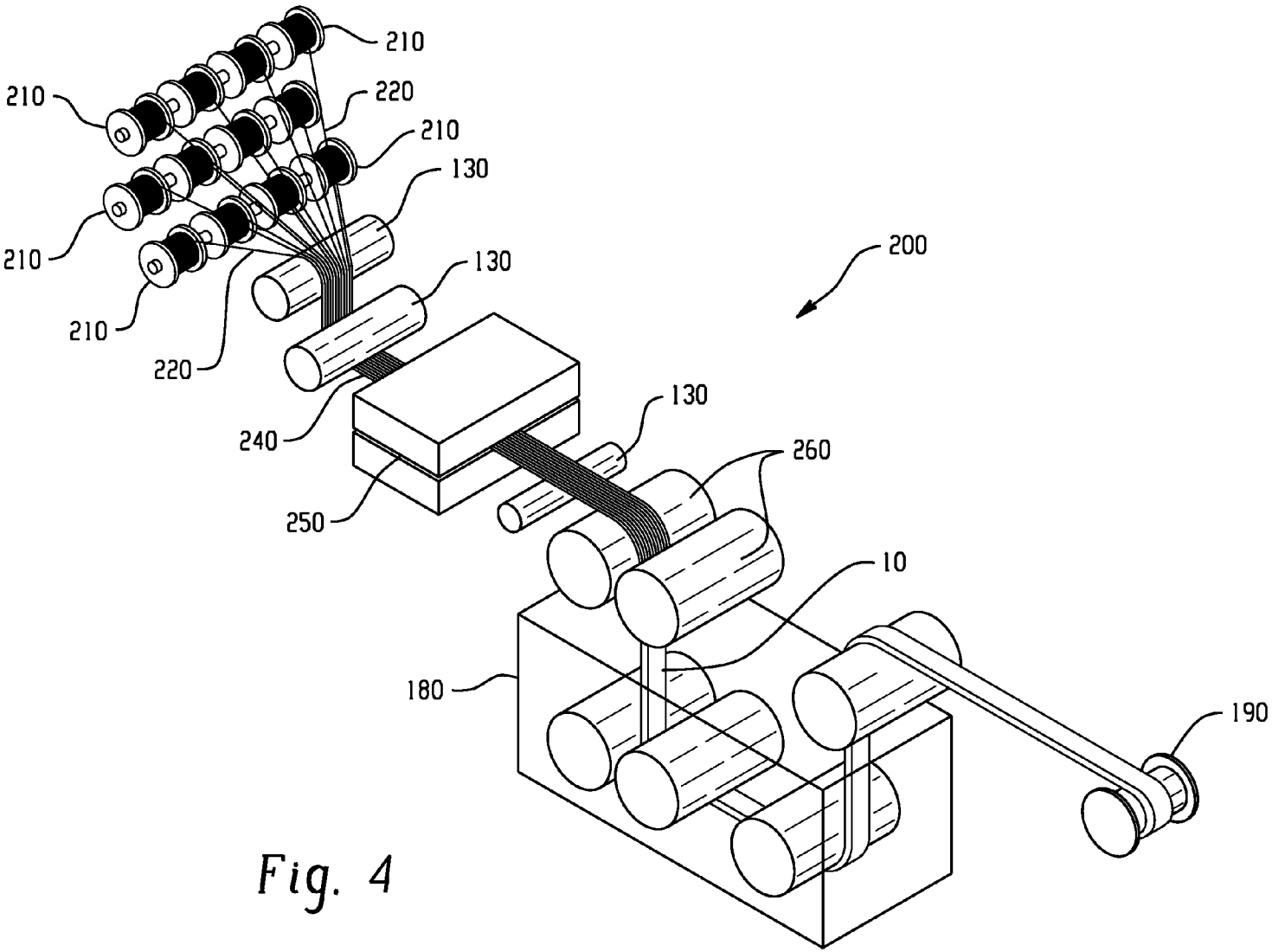
FIG. 4 is a pictorial representation of an apparatus for forming a multiconductor cable assembly from coated wire.

Apparatus suitable for conducting second (coated wire fusing) step of the two-step method is described, for example, in U.S. Pat. No. 2,749,261 to Hardison, U.S. Pat. Nos. 4,381,208 and 4,430,139 to Baverstock, U.S. Pat. No. 6,273,977 to Harden et al., and Great Britain Patent Specification No. 678,042. FIG. 4 is a pictorial representation of an apparatus 200 for conducting the heat-fusing step of the two-step method. The apparatus 200 comprises a plurality of coated wire bobbins 210, each feeding a coated wire 220 to rollers 130 where the coated wires 220 are aligned in parallel fashion with a pre-determined distance between adjacent coated wires 220. The aligned coated wires 240 are transported through a preheating zone 250, then through the nip defined by heating rollers 260, where the aligned coated wires 240 are fused to form the multiconductor cable assembly 10. The newly form multiconductor cable assembly 10 is transported through a water bath 180, where it is cooled, and wound onto a receiving reel 190.

It will be understood that although particular cable-forming embodiments are described as "one-step" or "two-step" for brevity, the associated methods are not limited to any particular number of discrete steps. The labels are intended merely to distinguish between methods in which uncoated conductors are individually coated before the multiconductor cable assembly is fabricated ("two-step") and methods in which uncoated conductors are collectively coated during the multiconductor cable assembly fabrication process ("one-step").

The invention includes at least the following embodiments.

Embodiment 1: A multiconductor cable assembly comprising two or more coated wires arranged in a side-by-side contiguous relation providing one or more interfacing contact areas between adjacent coated wires; wherein each of the two or more coated wires comprises a conductor, and a covering comprising a thermoplastic composition comprising 20 to 50 weight percent of a poly(arylene ether), 30 to 50 weight percent of a block copolymer comprising a poly(alkenyl aromatic) block and a polyolefin block, 5 to 25 weight percent of a flame retardant, and 0 to 10 weight percent of a polyolefin; wherein all weight percents are based on the total weight of the thermoplastic composition; and wherein the thermoplastic composition exhibits a flexural modulus of 50 to 1,000 megapascals, measured at 23° C. according to ASTM D790.

Embodiment 2: The multiconductor cable assembly of embodiment 1, wherein the thermoplastic composition comprises 1 to 10 weight percent of a polyolefin consisting of a polybutene.

Embodiment 3: The multiconductor cable assembly of embodiment 1 or 2, wherein the flame retardant is selected from the group consisting of triaryl phosphates, metal phosphinates, melamine salts, metal borate salts, metal hydroxides, and combinations thereof.

Embodiment 4: The multiconductor cable assembly of any of embodiments 1-3, wherein the thermoplastic composition excludes ethylene homopolymers and propylene homopolymers.

Embodiment 5: The multiconductor cable assembly of any of embodiments 1-4, wherein the conductor has a diameter of 0.2546 to 0.8128 millimeter.

Embodiment 6: The multiconductor cable assembly of any of embodiments 1-5, wherein the thermoplastic composition comprises 20 to 40 weight percent of a poly(2,6-dimethyl-1,4-phenylene ether) having an intrinsic viscosity of 0.3 to 0.6 deciliter per gram measured at 25° C. in chloroform, 30 to 50 weight percent of a triblock copolymer selected from the group consisting of polystyrene-poly(ethylene-butylene)-polystyrene triblock copolymers, polystyrene-poly(ethylene-butylene-styrene)-polystyrene triblock copolymers, and mixtures thereof, 2 to 6 weight percent of a polybutene, and 10 to 20 weight percent of a flame retardant selected from the group consisting of triaryl phosphates, melamine polyphosphates, metal phosphinates, magnesium hydroxides, and mixtures thereof; and wherein the thermoplastic composition exhibits a flexural modulus of 100 to 800 megapascals, measured at 23° C. according to ASTM D790, a tensile strength of 10 to 35 megapascals measured at 23° C. according to ASTM D638, a tensile elongation at break of 50 to 200 percent, measured at 23° C. according to ASTM D638, and a passing flame test rating according to UL 1581, Section 1080 measured on a test sample coated wire consisting of an AWG 28 conductor having a nominal diameter of 0.318 millimeter and a tubular covering comprising the thermoplastic composition and having a nominal outer diameter of 1.075 millimeters.

Embodiment 7: The multiconductor cable assembly of any of embodiments 1-6, wherein the thermoplastic composition further exhibits a UL 94 Vertical Burning Flame Test rating of V-0 at a sample thickness of 6 millimeters.

Embodiment 8: A method of forming a multiconductor cable assembly, comprising arranging two or more uncoated conductors, each having a diameter of 0.2546 to 0.8128 millimeter, in a side-by-side relationship in which the uncoated conductors are essentially parallel to each other and spaced relative to each other by a center-to-center distance of at least 1.5 times the diameter of the uncoated conductors; and extrusion coating the two or more temperature-adjusted uncoated conductors with a thermoplastic composition having a temperature of 230 to 290° C. to form the multiconductor cable assembly; wherein the extrusion coating is conducted at a line speed of 3 to 10 meters per minute; and wherein the thermoplastic composition comprises 20 to 50 weight percent of a poly(arylene ether), 30 to 50 weight percent of a block copolymer comprising a poly(alkenyl aromatic) block and a polyolefin block, 5 to 25 weight percent of a flame retardant, and 0 to 10 weight percent of a polyolefin; wherein all weight percents are based on the total weight of the thermoplastic composition; and wherein the thermoplastic composition exhibits a flexural modulus of 50 to 1,000 megapascals, measured at 23° C. according to ASTM D790.

Embodiment 9: The method of embodiment 8, further comprising adjusting the two or more uncoated conductors to a temperature of 80 to 150° C. before the extrusion coating.

Embodiment 10: The method of embodiment 8 or 9, wherein the thermoplastic composition comprises 1 to 10 weight percent of a polyolefin consisting of a polybutene.

Embodiment 11: The method of any of embodiments 8-10, wherein the flame retardant is selected from the group consisting of triaryl phosphates, metal phosphinates, melamine salts, metal borate salts, metal hydroxides, and combinations thereof.

Embodiment 12: The method of any of embodiments 8-11, wherein the thermoplastic composition excludes ethylene homopolymers and propylene homopolymers.

Embodiment 13: The method of any of embodiments 8-12, wherein the uncoated conductor has a diameter of 0.2546 to 0.8128 millimeter.

Embodiment 14: The method of any of embodiments 8-13, wherein the thermoplastic composition comprises 20 to 40 weight percent of a poly(2,6-dimethyl-1,4-phenylene ether) having an intrinsic viscosity of 0.3 to 0.6 deciliter per gram measured at 25° C. in chloroform, 30 to 50 weight percent of a triblock copolymer selected from the group consisting of polystyrene-poly(ethylene-butylene)-polystyrene triblock copolymers, polystyrene-poly(ethylene-butylene-styrene)-polystyrene triblock copolymers, and mixtures thereof, 2 to 6 weight percent of a polybutene, and 10 to 20 weight percent of a flame retardant selected from the group consisting of triaryl phosphates, melamine polyphosphates, metal phosphinates, magnesium hydroxides, and mixtures thereof; and wherein the thermoplastic composition exhibits a flexural modulus of 100 to 800 megapascals, measured at 23° C. according to ASTM D790, a tensile strength of 10 to 35 megapascals measured at 23° C. according to ASTM D638, a tensile elongation at break of 50 to 200 percent, measured at 23° C. according to ASTM D638, and a passing flame test rating according to UL 1581, Section 1080 measured on a test sample coated wire consisting of an AWG 28 conductor having a nominal diameter of 0.318 millimeter and a tubular covering comprising the thermoplastic composition and having a nominal outer diameter of 1.075 millimeters.

Embodiment 15: The method of any of embodiments 8-14, wherein the thermoplastic composition further exhibits a UL 94 Vertical Burning Flame Test rating of V-0 at a sample thickness of 6 millimeters.

Embodiment 16: A method of forming a multiconductor cable assembly, comprising: arranging two or more coated wires in a side-by-side contiguous relationship to provide contact areas between adjacent coated wires; adjusting the surface temperature of the two or more coated wires to 150 to 180° C.; and passing the temperature-adjusted coated wires through a nip defined by two rollers to form the multiconductor cable assembly, wherein each roller independently has a surface temperature of 180 to 220° C.; and wherein the multiconductor cable assembly has a surface temperature of 145 to 210° C. as it exits the nip; wherein the two or more coated wires each comprise a conductor having a diameter $D_1$ and a covering disposed on the conductor and having an outer diameter $D_2$, and wherein the nip is $1.1 \times D_1$ to $1.1 \times D_2$; wherein the passing the temperature-adjusted coated wires through a nip is conducted at a line speed of 3 to 10 meters per minute; and wherein the thermoplastic composition comprises 20 to 50 weight percent of a poly(arylene ether), 30 to 50 weight percent of a block copolymer comprising a poly (alkenyl aromatic) block and a polyolefin block, 5 to 25 weight percent of a flame retardant, and 0 to 10 weight percent of a polyolefin, wherein all weight percents are based on the total weight of the thermoplastic composition; and wherein the thermoplastic composition exhibits a flexural modulus of 50 to 1,000 megapascals, measured at 23° C. according to ASTM D790.

Embodiment 17: The method of embodiment 16, wherein the thermoplastic composition comprises 1 to 10 weight percent of a polyolefin consisting of a polybutene.

Embodiment 18: The method of embodiment 16 or 17, wherein the flame retardant is selected from the group consisting of triaryl phosphates, metal phosphinates, melamine salts, metal borate salts, metal hydroxides, and combinations thereof.

Embodiment 19: The method of any of embodiments 16-18, wherein the thermoplastic composition excludes ethylene homopolymers and propylene homopolymers.

Embodiment 20: The method of any of embodiments 16-19, wherein the coated wire comprises a conductor and a covering disposed on the conductor; wherein the conductor has a diameter of 0.2546 to 0.8128 millimeter.

Embodiment 21: The method of any of embodiments 16-20, wherein the thermoplastic composition comprises 20 to 40 weight percent of a poly(2,6-dimethyl-1,4-phenylene ether) having an intrinsic viscosity of 0.3 to 0.6 deciliter per gram measured at 25° C. in chloroform, 30 to 50 weight percent of a triblock copolymer selected from the group consisting of polystyrene-poly(ethylene-butylene)-polystyrene triblock copolymers, polystyrene-poly(ethylene-butylene-styrene)-polystyrene triblock copolymers, and mixtures thereof, 2 to 6 weight percent of a polybutene, and 10 to 20 weight percent of a flame retardant selected from the group consisting of triaryl phosphates, melamine polyphosphates, metal phosphinates, magnesium hydroxides, and mixtures thereof; and wherein the thermoplastic composition exhibits a flexural modulus of 100 to 800 megapascals, measured at 23° C. according to ASTM D790, a tensile strength of 10 to 35 megapascals measured at 23° C. according to ASTM D638, a tensile elongation at break of 50 to 200 percent, measured at 23° C. according to ASTM D638, and a passing flame test rating according to UL 1581, Section 1080 measured on a test sample coated wire consisting of an AWG 28 conductor having a nominal diameter of 0.318 millimeter and a tubular covering comprising the thermoplastic composition and having a nominal outer diameter of 1.075 millimeters.

Embodiment 22: The method of any of embodiments 16-21, wherein the thermoplastic composition further exhibits a UL 94 Vertical Burning Flame Test rating of V-0 at a sample thickness of 6 millimeters.

The invention is further illustrated by the following non-limiting examples.

EXAMPLE 1

Components used to form the melt-blended thermoplastic compositions are described in Table 1.

TABLE 1

| Component | Description |
|---|---|
| PPE 0.46 | Poly(2,6-dimethyl-1,4-phenylene ether) having an intrinsic viscosity of 0.46 deciliter per gram; obtained as PPO 646 from SABIC Innovative Plastics. |
| PPE 0.40 | Poly(2,6-dimethyl-1,4-phenylene ether) having an intrinsic viscosity of 0.40 deciliter per gram; obtained as PPO 640 from SABIC Innovative Plastics. |
| SEBS I | Polystyrene-poly(ethylene/butylene)-polystyrene) triblock copolymer, CAS Reg. No. 66070-58-4, having a polystyrene content of 33%; obtained as Kraton G1651 from Kraton Polymers Ltd. |
| SEBS II | Polystyrene-poly(ethylene/butylene)-polystyrene triblock copolymer, CAS Reg. No. 66070-58-4, having a polystyrene content of 30%; obtained as Kraton G1650 from Kraton Polymers Ltd. |
| SEBS III | Polystyrene-poly(ethylene/butylene/styrene)-polystyrene triblock copolymer, having a polystyrene content of 40 weight percent; obtained as Kraton RP6936 from Kraton Polymers Ltd. |
| Polybutene | Polybutene, CAS Reg. No. 9003-29-6, having a number average molecular weight of 800 grams per mole and a polydispersity index of 1.60; obtained as Indopol H-50 from BP Chemical. |
| RDP | Resorcinol bis(diphenyl phosphate), CAS Reg. No. 57583-54-7; obtained as CR733S from Daihachi Chemical |
| BPADP | Bisphenol A bis(diphenyl phosphate), CAS Reg. No. 181028-79-5; obtained as Fyrolflex BDP from Supresta LLC or Reofos BAPP from Great Lakes Chemical Co. Ltd. |
| MPolyP | Melamine polyphosphate; obtained as Melapur 200/70 (CAS Reg. No. 218768-84-4) from Ciba Specialty Co. Ltd. |
| $Mg(OH)_2$ | Magnesium hydroxide, CAS Reg. No. 1309-42-8; obtained as Kisuma 5a from Kyowa Chemical |
| $CaCO_3$ | Calcium carbonate, CAS Reg. No. 471-34-1; obtained from Shiraishi Calcium |
| MPyroP | Melamine pyrophosphate, CAS Reg. No. 15541-60-3; obtained as Budit 311 from Budenheim Iberica, S.A. |
| Kemamide | Stearyl erucamide, CAS Reg. No. 10094-45-8; obtained as Kemamide E-180 from Crompton Corporation |

Specific compositions are detailed in Table 2, where component amounts are expressed in parts by weight.

TABLE 2

| | Composition No. | | | | |
|---|---|---|---|---|---|
| | 1 | 2 | 3 | 4 | 5 |
| PPE 0.46 | 32 | 32 | 32 | 35 | 35 |
| PPE 0.40 | 0 | 0 | 0 | 0 | 0 |
| SEBS I | 0 | 0 | 0 | 20 | 20 |
| SEBS II | 18 | 18 | 18 | 0 | 0 |
| SEBS III | 25 | 25 | 25 | 20 | 20 |
| Polybutene | 5 | 5 | 5 | 2 | 2 |
| RDP | 8 | 8 | 8 | 18 | 18 |
| MPolyP | 3.5 | 3.5 | 3.5 | 0 | 0 |
| $Mg(OH)_2$ | 5 | 5 | 5 | 0 | 0 |
| $CaCO_3$ | 0 | 10 | 20 | 0 | 10 |
| MPyroP | 3 | 3 | 3 | 5 | 5 |

In the first step of the process, coated wire was formed using a single-screw extruder model D2-1053 from Omiya Seiki having a screw diameter of 60 millimeters, a screw length-to-diameter ratio of 24:1, a line speed of 50 to 400 meters per minute, a 0.318 millimeter diameter copper wire core, an extrusion melt temperature of 250 to 290° C., a cooling bath temperature of 15 to 80° C., and a pellet pre-drying time of 4 to 6 hours at 80 to 90° C. The resulting coated wire had a diameter of 1.075 millimeters and an insulation thickness of 0.378 millimeters. In the second step of the process, ribbonized wire consisting of 20 or 40 fused strands was formed by creating a parallel arrangement of coated wires separated by a distance of 1.27 millimeters, preheating the still-separated individual coated wires to 120 to 160° C. in a pre-heating zone corresponding to part 250 in FIG. 4, then fusing the wires by passing them through a 0.95 millimeter nip defined by two 200 centimeter diameter heating rolls maintained at 180 to 220° C. (corresponding to part 260 in FIG. 4). The multiconductor cable assembly had a pitch of 1.27 millimeters. Process variations are summarized in Table 3.

The entries in the last column of Table 3 indicate whether or not it was possible to form a ribbonized cable using the specific conditions employed. For conditions capable of forming a ribbonized cable, the tear strength of the resulting cable was evaluated manually to check the connection strength between wires.

The results in Table 3 demonstrate that the actual temperature of the heating roll is important and should be greater than or equal to 145° C.

TABLE 3

| | Compos. No. | Pre-Heater Zone: Upper Heater Set Temp. (° C.) | Pre-Heater Zone: Lower Heater Set Temp. (° C.) | Internal Temp. (° C.) | Wire Surface Temp. (° C.) | Heating Roll: Entrance Side Set Temp. (° C.) | Heating Roll: Exit Side Set Temp. (° C.) | Heating Roll: Cable Surface Temp.[1] (° C.) | Line Speed (m/min) | Tear Strength | Comments[2] |
|---|---|---|---|---|---|---|---|---|---|---|---|
| Ex. 1 | 4 | 266 | 266 | 120 | 158 | 160 | 160 | 131 | 2.6 | — | N |
| Ex. 2 | 4 | 300 | 300 | 130 | 138 | 170 | 170 | 140 | 3.4 | — | N |
| Ex. 3 | 4 | 300 | 300 | 130 | 138 | 195 | 191 | 140 | 3.4 | — | N |
| Ex. 4 | 4 | 300 | 300 | 140 | 140 | 197 | 192 | 140 | 3.4 | — | N |
| Ex. 5 | 5 | 266 | 266 | 120 | 158 | 160 | 160 | 131 | 2.6 | — | N |
| Ex. 6 | 5 | 300 | 300 | 130 | 138 | 170 | 170 | 140 | 3.4 | — | N |
| Ex. 7 | 5 | 300 | 300 | 130 | 138 | 195 | 191 | 140 | 3.4 | — | N |
| Ex. 8 | 5 | 300 | 300 | 140 | 140 | 197 | 192 | 140 | 3.4 | poor | N |
| Ex. 9 | 4 | 300 | 300 | 135-140 | 143-145 | 208 | 202 | 145 | 3.4 | fair | Y |
| Ex. 10 | 5 | 300 | 300 | 135-140 | 143-145 | 208 | 202 | 145 | 3.4 | fair | Y |
| Ex. 11 | 1 | 290 | 290 | 140 | 154 | 202 | 200 | 187 | 3.2 | good | Y |
| Ex. 12 | 2 | 290 | 290 | 140 | 155 | 200 | 196 | 187 | 3.2 | good | Y |
| Ex. 13 | 3 | 290 | 290 | 159 | 155 | 200 | 196 | 187 | 2.3 | good | Y |
| Ex. 14 | 3 | 290 | 290 | 175 | 155 | 200 | 196 | 187 | 2.0 | good | Y |

[1]"Cable Surface Temp." is the measured surface temperature of the multiconductor cable assembly immediately after contacting the heating roll (that is, immediately after exiting the nip)
[2]a value of "Y" means that ribbonized cable could be formed; a value of "N" means that ribbonized cable could not be formed due to poor adhesion between wires

EXAMPLES 15-18

These examples illustrate the physical properties of compositions used to form the covering of the ribbonized wire.

Compositions were compounded as described above for Composition Nos. 1-5. Test bars for physical property measurements were molded using a barrel temperature of 250° C. and a mold temperature of 60° C. For the Table 4 Molded Bar Properties, tensile strength values, expressed in megapascals, and tensile elongation values, expressed in percent, were measured at 23° C. according to ASTM D638; flexural modulus values, expressed in megapascals, were measured at 23° C. according to ASTM D790; Shore A hardness values, which are unitless, were measured at 25° C. according to ASTM D 2240 using a Rex Model DD-3-A digital durometer with OS-2H operating stand; melt flow index values, expressed in grams per 10 minutes, were measured at 250° C. and a load of 10 kilograms according to ASTM D1238; UL94 flammability ratings were determined using the UL 94 Vertical Burning Flame Test using a sample thickness of 6 millimeters.

Ribbonized wires were prepared as described above for Examples 1-14, using a pre-heater upper heater set temperature of 266-300° C., a pre-heater lower heater set temperature of 266-300° C., a pre-heater internal temperature of 120-175° C., a wire surface temperature of 138-158° C., a heating roll entrance side set temperature of 160-208° C., a heating roll exit side set temperature of 160-202° C., a heating roll actual temperature of 131-187° C., and a line speed of 2.0-3.4 meters/minute. For the Ribbonized Wire Properties in Table 4, "Heat deformation at 121 ° C." refers to heat deformation measured according to UL1581, Section 560; "UL1581 VW-1 rating" refers to the flammability value determined according to UL 1581, Section 1080 (VW-1 Vertical Specimen); "Other mechanical" (ultimate elongation and tensile strength) refers to UL1581 Section 470; "Heat ageing" refers to UL1581, Section 480; and "Ribbonization" refers to the ability to form a multiconductor cable assembly.

The results presented in Table 4, especially those for Examples 15 and 16, demonstrate the formation of ribbon cables that meet all the associated requirements. Although the Example 17 and 18 compositions were not evaluated in the fabrication of multiconductor cable assembly, they are expected to function well.

TABLE 4

| | Ex. 15 | Ex. 16 | Ex. 17 | Ex. 18 |
|---|---|---|---|---|
| COMPOSITIONS | | | | |
| PPE 0.46 | 35 | 32 | 32 | 0 |
| PPE 0.40 | 0 | 0 | 0 | 32 |
| SEBS I | 20 | 0 | 0 | 0 |
| SEBS II | 0 | 18 | 18 | 18 |
| SEBS III | 20 | 25 | 25 | 25 |
| Polybutene | 2 | 5 | 5 | 5 |
| RDP | 18 | 8 | 0 | 0 |
| BPADP | 0 | 0 | 9 | 9 |
| MPolyP | 0 | 3.35 | 6.5 | 6.5 |
| $Mg(OH)_2$ | 0 | 5 | 5 | 5 |
| $CaCO_3$ | 10 | 10 | 10 | 10 |
| MPyroP | 5 | 3 | 0 | 0 |
| Kemamide | 1 | 0.5 | 1 | 1 |
| MOLDED BAR PROPERTIES | | | | |
| Tensile strength (MPa) | 19 | 19 | 19 | 19 |
| Tensile Elongation (%) | 100 | 90 | 80 | 90 |
| Flexural Modulus (MPa) | 720 | 380 | 480 | 470 |
| Shore A Hardness | 95 | 91 | 92 | 92 |
| Melt flow index (g/10 min) | 8 | 11 | 12 | 14 |
| UL94 flammability rating | V-0 | V-0 | V-0 | V-0 |
| RIBBONIZED WIRE PROPERTIES | | | | |
| Heat deformation at 121° C. | pass | pass | — | — |
| UL1581 VW-1 rating | pass | pass | — | — |
| Other mechanical | pass | pass | — | — |
| Heat ageing | pass | pass | — | — |
| Ribbonization | pass | pass | — | — |

EXAMPLES 19-31

These examples illustrate a one-step method for forming a multiconductor cable assembly using the thermoplastic composition.

The thermoplastic compositions used were Compositions 1-4 as specified in Table 2, above, and Compositions 5 and 6, which are specified in Table 5, where component amounts are expressed in parts by weight.

TABLE 5

| | Compos. 5 | Compos. 6 |
|---|---|---|
| PPE 0.46 | 40 | 31 |
| PPE 0.40 | 0 | 0 |
| SEBS I | 20 | 0 |
| SEBS II | 0 | 16.5 |
| SEBS III | 27 | 28 |
| Polybutene | 0 | 5 |
| RDP | 13 | 0 |
| BPADP | 0 | 9 |
| MPolyP | 0 | 5 |
| $Mg(OH)_2$ | 0 | 5 |
| $CaCO_3$ | 0 | 0 |
| MPyroP | 0 | 0 |

A multiconductor cable assembly was fabricated in a continuous one-step process using wire extrusion equipment model D2-1053 from Omiya Seiki. The specified compositions (which had previously been compounded and pelletized) were added at the feedthroat of a single-screw extruder having a 60-millimeter screw diameter, a screw length-to-diameter ratio of 24: 1, and four cylinders (barrels) with separately adjustable temperatures. The temperatures of the four cylinders were varied, as were the temperatures of the "adapter" and the D1, D2, and D3 subcomponents of the die head. The "adapter" is located between the extruder and the neck, D1 is the neck, D2 is the die entrance, and D3 is the die head. After exiting the die, the multicomponent cable newly formed multiconductor cable assembly was cooled in a water bath, and gathered on a spool.

Process variations and cable evaluation results are summarized in Table 6. The results show that both the thermoplastic composition and the extrusion conditions are critical to achieving formation of an acceptable ribbon cable.

TABLE 6

| Ex. No. | Comp. No. | Cylinder Temp. (° C.) C1 | C2 | C3 | C4 | Adapter Temp. (° C.) | Die Head Temp. (° C.) D1 | D2 | D3 | Screw Speed (rpm) | Line Speed (m/min) | Tear Strength | Comments[1] |
|---|---|---|---|---|---|---|---|---|---|---|---|---|---|
| 19 | 4 | 260 | 270 | 280 | 280 | 280 | 280 | 280 | 280 | 12.5 | 3 | fair | N |
| 20 | 4 | 240 | 250 | 260 | 260 | 280 | 280 | 280 | 280 | 28 | 8 | good | Y |
| 21 | 4 | 250 | 250 | 260 | 260 | 270 | 270 | 270 | 270 | 6 | 3 | poor | N |
| 22 | 4 | 250 | 250 | 260 | 260 | 270 | 270 | 270 | 270 | 31 | 8.6 | good | Y |
| 23 | 4 | 250 | 260 | 260 | 250 | 260 | 260 | 260 | 260 | 34 | 8.5 | poor | N |
| 24 | 4 | 250 | 250 | 260 | 260 | 250 | 250 | 250 | 250 | 31 | 8.5 | good | Y |
| 25 | 6 | 260 | 260 | 270 | 260 | 260 | 260 | 260 | 260 | 14 | 4 | poor | N |
| 26 | 6 | 260 | 265 | 275 | 275 | 265 | 265 | 256 | 265 | 12 | 4 | poor | N |
| 27 | 6 | 260 | 270 | 280 | 280 | 270 | 270 | 270 | 270 | 12 | 4 | good | Y |
| 28 | 6 | 260 | 260 | 270 | 270 | 260 | 260 | 260 | 260 | 7 | 2.3 | good | Y |
| 29 | 1 | 260 | 260 | 270 | 275 | 275 | 275 | 275 | 275 | 8 | 3 | good | Y |
| 30 | 2 | 260 | 260 | 270 | 270 | 270 | 270 | 270 | 270 | 8 | 3.1 | good | Y |
| 31 | 3 | 260 | 260 | 270 | 270 | 270 | 270 | 270 | 270 | 11 | 4.1 | good | Y |

[1]a value of "Y" means that ribbonized cable could be formed; a value of "N" means that ribbonized cable could not be formed due to poor adhesion between wires This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

All cited patents, patent applications, and other references are incorporated herein by reference in their entirety. However, if a term in the present application contradicts or conflicts with a term in the incorporated reference, the term from the present application takes precedence over the conflicting term from the incorporated reference.

All ranges disclosed herein are inclusive of the endpoints, and the endpoints are independently combinable with each other.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The invention claimed is:

1. A multiconductor cable assembly comprising two or more coated wires arranged in a side-by-side contiguous relation providing one or more interfacing contact areas between adjacent coated wires;

wherein each of the two or more coated wires comprises a conductor, and a covering comprising a thermoplastic composition comprising 20 to 50 weight percent of a poly(arylene ether), 30 to 50 weight percent of a block copolymer comprising a poly(alkenyl aromatic) block and a polyolefin block, 5 to 25 weight percent of a flame retardant, and 0 to 10 weight percent of a polyolefin;

wherein all weight percents are based on the total weight of the thermoplastic composition; and wherein the thermoplastic composition exhibits a flexural modulus of 50 to 1,000 megapascals, measured at 23° C. according to ASTM D790.

2. The multiconductor cable assembly of claim 1, wherein the thermoplastic composition comprises 1 to 10 weight percent of a polyolefin consisting of a polybutene.

3. The multiconductor cable assembly of claim 1, wherein the flame retardant is selected from the group consisting of triaryl phosphates, metal phosphinates, melamine salts, metal borate salts, metal hydroxides, and combinations thereof.

4. The multiconductor cable assembly of claim 1, wherein the thermoplastic composition excludes ethylene homopolymers and propylene homopolymers.

5. The multiconductor cable assembly of claim 1, wherein the conductor has a diameter of 0.2546 to 0.8128 millimeter.

6. The multiconductor cable assembly of claim 1, wherein the thermoplastic composition comprises 20 to 40 weight percent of a poly(2,6-dimethyl-1,4-phenylene ether) having an intrinsic viscosity of 0.3 to 0.6 deciliter per gram measured at 25° C. in chloroform, 30 to 50 weight percent of a triblock copolymer selected from the group consisting of polystyrene-poly(ethylene-butylene)-polystyrene triblock copolymers, polystyrene-poly(ethylene-butylene-styrene)-polystyrene triblock copolymers, and mixtures thereof, 2 to 6 weight percent of a polybutene, and 10 to 20 weight percent of a flame retardant selected from the group consisting of triaryl phosphates, melamine polyphosphates, metal phosphinates, magnesium hydroxides, and mixtures thereof; and wherein the thermoplastic composition exhibits a flexural modulus of 100 to 800 megapascals, measured at 23° C. according to ASTM D790, a tensile strength of 10 to 35 megapascals measured at 23° C. according to ASTM D638, a tensile elongation at break of 50 to 200 percent, measured at 23° C. according to ASTM D638, and a passing flame test rating according to UL 1581, Section 1080 measured on a test sample coated wire consisting of an AWG 28 conductor having a nominal diameter of 0.318 millimeter and a tubular covering comprising the thermoplastic composition and having a nominal outer diameter of 1.075 millimeters.

7. The multiconductor cable assembly of claim 1, wherein the thermoplastic composition further exhibits a UL 94 Vertical Burning Flame Test rating of V-0 at a sample thickness of 6 millimeters.

8. A method of forming a multiconductor cable assembly, comprising arranging two or more uncoated conductors, each having a diameter of 0.2546 to 0.8128 millimeter, in a side-by-side relationship in which the uncoated conductors are essentially parallel to each other and spaced relative to each other by a center-to-center distance of at least 1.5 times the diameter of the uncoated conductors; and extrusion coating the two or more temperature-adjusted uncoated conductors with a thermoplastic composition having a temperature of 230 to 290° C. to form the multiconductor cable assembly;

wherein the extrusion coating is conducted at a line speed of 3 to 10 meters per minute; and wherein the thermoplastic composition comprises 20 to 50 weight percent of a poly(arylene ether), 30 to 50 weight percent of a block copolymer comprising a poly(alkenyl aromatic) block and a polyolefin block, 5 to 25 weight percent of a flame retardant, and 0 to 10 weight percent of a polyolefin;

wherein all weight percents are based on the total weight of the thermoplastic composition; and wherein the thermoplastic composition exhibits a flexural modulus of 50 to 1,000 megapascals, measured at 23° C. according to ASTM D790.

9. The method of claim 8, further comprising adjusting the two or more uncoated conductors to a temperature of 80 to 150° C. before the extrusion coating.

10. The method of claim 8, wherein the thermoplastic composition comprises 1 to 10 weight percent of a polyolefin consisting of a polybutene.

11. The method of claim 8, wherein the flame retardant is selected from the group consisting of triaryl phosphates, metal phosphinates, melamine salts, metal borate salts, metal hydroxides, and combinations thereof.

12. The method of claim 8, wherein the thermoplastic composition excludes ethylene homopolymers and propylene homopolymers.

13. The method of claim 8, wherein the uncoated conductor has a diameter of 0.2546 to 0.8128 millimeter.

14. The method of claim 8, wherein the thermoplastic composition comprises 20 to 40 weight percent of a poly(2,6-dimethyl-1,4-phenylene ether) having an intrinsic viscosity of 0.3 to 0.6 deciliter per gram measured at 25° C. in chloroform, 30 to 50 weight percent of a triblock copolymer selected from the group consisting of polystyrene-poly(ethylene-butylene)-polystyrene triblock copolymers, polystyrene-poly(ethylene-butylene-styrene)-polystyrene triblock copolymers, and mixtures thereof, 2 to 6 weight percent of a polybutene, and 10 to 20 weight percent of a flame retardant selected from the group consisting of triaryl phosphates, melamine polyphosphates, metal phosphinates, magnesium hydroxides, and mixtures thereof; and wherein the thermoplastic composition exhibits a flexural modulus of 100 to 800 megapascals, measured at 23° C. according to ASTM D790, a tensile strength of 10 to 35 megapascals measured at 23° C. according to ASTM D638, a tensile elongation at break of 50 to 200 percent, measured at 23° C. according to ASTM D638, and a passing flame test rating according to UL 1581, Section 1080 measured on a test sample coated wire consisting of an AWG 28 conductor having a nominal diameter of 0.318 millimeter and a tubular covering comprising the thermoplastic composition and having a nominal outer diameter of 1.075 millimeters.

15. The method of claim 8, wherein the thermoplastic composition further exhibits a UL 94 Vertical Burning Flame Test rating of V-0 at a sample thickness of 6 millimeters.

16. A method of forming a multiconductor cable assembly, comprising:

arranging two or more coated wires in a side-by-side contiguous relationship to provide contact areas between adjacent coated wires;

adjusting the surface temperature of the two or more coated wires to 150 to 180° C.; and passing the temperature-adjusted coated wires through a nip defined by two rollers to form the multiconductor cable assembly, wherein each roller independently has a surface temperature of 180 to 220° C.; and wherein the multiconductor cable assembly has a surface temperature of 145 to 210° C. as it exits the nip;

wherein the two or more coated wires each comprise a conductor having a diameter $D_1$ and a covering disposed on the conductor and having an outer diameter $D_2$, and wherein the nip is $1.1 \times D_1$ to $1.1 \times D_2$;

wherein the passing the temperature-adjusted coated wires through a nip is conducted at a line speed of 3 to 10 meters per minute; and wherein the thermoplastic composition comprises 20 to 50 weight percent of a poly(arylene ether), 30 to 50 weight percent of a block copolymer comprising a poly(alkenyl aromatic) block and a polyolefin block, 5 to 25 weight percent of a flame retardant, and 0 to 10 weight percent of a polyolefin, wherein all weight percents are based on the total weight of the thermoplastic composition; and wherein the thermoplastic composition exhibits a flexural modulus of 50 to 1,000 megapascals, measured at 23° C. according to ASTM D790.

17. The method of claim 16, wherein the thermoplastic composition comprises 1 to 10 weight percent of a polyolefin consisting of a polybutene.

18. The method of claim 16, wherein the flame retardant is selected from the group consisting of triaryl phosphates, metal phosphinates, melamine salts, metal borate salts, metal hydroxides, and combinations thereof.

19. The method of claim 16, wherein the thermoplastic composition excludes ethylene homopolymers and propylene homopolymers.

20. The method of claim 16, wherein the coated wire comprises a conductor and a covering disposed on the conductor; wherein the conductor has a diameter of 0.2546 to 0.8128 millimeter.

21. The method of claim 16, wherein the thermoplastic composition comprises 20 to 40 weight percent of a poly(2,6-dimethyl-1,4-phenylene ether) having an intrinsic viscosity of 0.3 to 0.6 deciliter per gram measured at 25° C. in chloroform, 30 to 50 weight percent of a triblock copolymer selected from the group consisting of polystyrene-poly(ethylene-butylene)-polystyrene triblock copolymers, polystyrene-poly(ethylene-butylene-styrene)-polystyrene triblock copolymers, and mixtures thereof, 2 to 6 weight percent of a polybutene, and 10 to 20 weight percent of a flame retardant selected from the group consisting of triaryl phosphates, melamine polyphosphates, metal phosphinates, magnesium hydroxides, and mixtures thereof; and wherein the thermoplastic composition exhibits a flexural modulus of 100 to 800 megapascals, measured at 23° C. according to ASTM D790, a tensile strength of 10 to 35 megapascals measured at 23° C. according to ASTM D638, a tensile elongation at break of 50 to 200 percent, measured at 23° C. according to ASTM D638, and a passing flame test rating according to UL 1581, Section 1080 measured on a test sample coated wire consisting of an AWG 28 conductor having a nominal diameter of 0.318 millimeter and a tubular covering comprising the thermoplastic composition and having a nominal outer diameter of 1.075 millimeters.

22. The method of claim 16, wherein the thermoplastic composition further exhibits a UL 94 Vertical Burning Flame Test rating of V-0 at a sample thickness of 6 millimeters.

* * * * *